US006213189B1

(12) United States Patent
Hörmann

(10) Patent No.: US 6,213,189 B1
(45) Date of Patent: Apr. 10, 2001

(54) DOOR LEAF

(75) Inventor: Michael Hörmann, Halle (DE)

(73) Assignee: Marantec Antriebs-und Steuerungstechnik GmbH & Co. Produktions KG, Marienfeld (DE)

( * ) Notice: Subject to any disclaimer, the term of this patent is extended or adjusted under 35 U.S.C. 154(b) by 0 days.

(21) Appl. No.: 09/234,569

(22) Filed: Jan. 20, 1999

(30) Foreign Application Priority Data

Jan. 20, 1998 (DE) ..... 298 00 908

(51) Int. Cl.[7] ..... E06B 3/48
(52) U.S. Cl. ..... 160/229.1
(58) Field of Search ..... 160/201, 229.1

(56) References Cited

U.S. PATENT DOCUMENTS 4,893,666 * 1/1990 Hormann ..... 160/201 X
5,002,114 * 3/1991 Hormann ..... 160/201 X
5,170,832 12/1992 Wagner .
5,669,431 * 9/1997 Druzynski et al. ..... 160/229.1
5,927,369 * 7/1999 Pedersen ..... 160/201

FOREIGN PATENT DOCUMENTS 216816 12/1909 (DE) .
29721316 1/1998 (DE) .
0370376 5/1990 (EP) .
0608683 8/1994 (EP) .
97/10405 3/1997 (WO) .

* cited by examiner

*Primary Examiner*—Jerry Redman
(74) *Attorney, Agent, or Firm*—Dilworth & Barrese, LLP

(57) ABSTRACT

The invention refers to a door or gate leaf having a plurality of plates hingedly connected to each other via hinge connections, said plates being pivotable with respect to each other when they are moved from the open position to the closing position or viceversa, wherein the plates each have a front wall and a rear wall as well as at least one plate edge resting against a respective plate edge of an adjacent plate, wherein a first plate edge has a profile with a profile section having a substantially concave design, wherein a second plate edge lying opposite thereto has a convex-shaped profile section being complementary to the concave-shaped profile section, wherein the curvatures of the concave-shaped or convex-shaped profile sections partially extend in a curved manner, in particular in a circular manner, or extend in a polygonal form approximately tracing the course of the curve, and, with its or their center(s) of the circle, lie approximately in or near the adjacent hinge axis or, with its or their polygonal focal point(s), lie such that they are directed towards the respective adjacent hinge axis, wherein the convex or concave profile section changes from a central curved section into a straight-line section being directed obliquely towards the front wall, and that the nose formed in the concave profile section in the region of the front wall is flattened in an inclined manner from its outside.

16 Claims, 1 Drawing Sheet

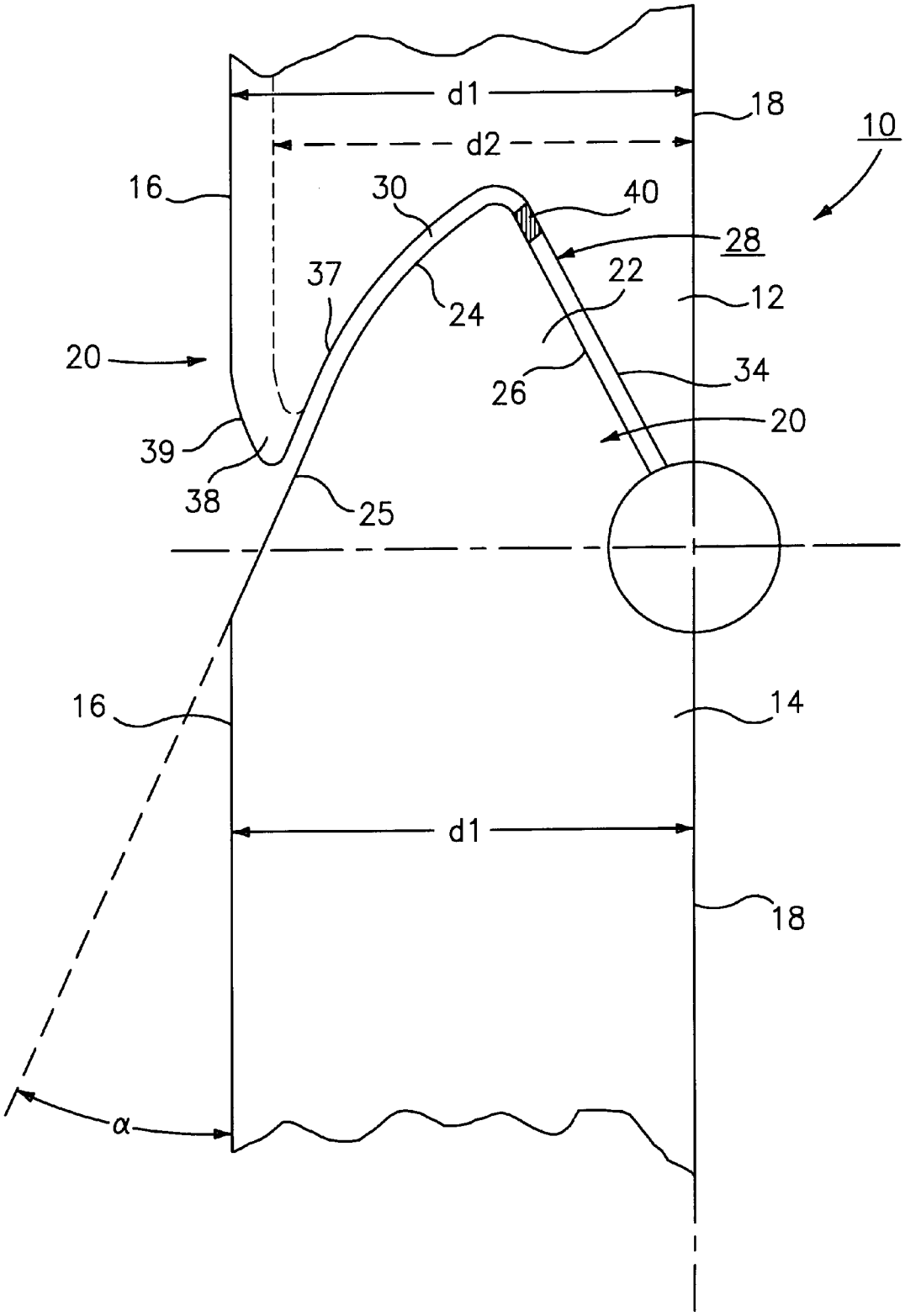
d1
18
10
d2
16
30
40
28
37
22
12
24
20
34
26
20
39
38
25
16
14
d1
18
α

DOOR LEAF

BACKGROUND OF THE INVENTION

The present invention refers to a leaf of a door or a gate with a plurality of plates hingedly connected via hinge connections, the plates being pivotable with respect to each other when they are moved from the open position to the closing position or visa versa, wherein the plates each have a front wall and a rear wall as well as at least one plate edge resting against a respective plate edge of an adjacent plate, a first plate edge has a profile with a profile section having a substantially concave design, a second plate edge lying opposite thereto having a convex-shaped profile section being complementary to the concave-shaped profile section, the curvatures of the concave-shaped or convex-shaped profile sections partially extending in a curved manner, in particular in a circular manner, or extending in a polygonal form approximately tracing the course of the curve and, with centers of the circle approximately lying near or adjacent to the hinged axis or with polygonal focal points lying in a direction towards the respective adjacent hinge axis.

Such a door leaf is for instance known from European patent publication 370 376 B1. During the movement from the open position into the closing position or viceversa, the plates of such a door leaf—in particular of a sectional gate—which are hingedly connected to each other successively in the direction of motion, travel through a curved guide region which is located between the approximately vertically directed straight-line guide section for receiving the door leaf in the closing position and the approximately horizontally extending guide section for receiving the door leaf in the open position. To this end, the plates are articulated at each other by hinges, the hinge axis of which extends at the inner side of the door leaf, that means at the rear wall of the door leaf and, thus, at the door leaf side facing the interior of the building room or the like to be closed by means of the door leaf. In order to prevent the creation of a gap between adjacent plates in pivoting positions thereof resulting from travelling through the curved guide region, into which gap the fingers of a person may be inserted unintentionally or in the course of an inappropriate manual handling of the door leaf, the front faces of the respective adjacent plates, which face each other, are of a more or less circularly arched design in cross-section and, with the center of the circular arc, lie approximately in the hinge axis. As a result, between the two arched front faces which face each other a gap is formed, respectively, which extends continuously between the outer side and the inner side of the door leaf. When leaving out of account separately provided elastic sealing strips, in the gap region of the outer side of the door leaf between the outer walls of the plates a joint is left free which passes over into the gap region between the concave and convex profile section. Said joint simulates a bead and also serves for the protection against jamming, as thereby it is prevented that the fingers get squeezed-in in the region of the front wall of the door leaf between the nose formed by the concave profile section and the opposed shoulder formed at the convex profile section.

The characteristics of the geometry in the region of the plate edges have already been known from German patent publication 216 816 dating from the year 1908. Therein, there has already been proposed a complementary convex or concave shaping for the opposed edges at a revolving door with strap hinges for preventing injuries caused by squeezing-in at the pivoting edge of the door.

In particular in case of larger gates or doors it is desirable that the plate thickness can be varied over the height of the gate. Hereto it is necessary according to prior art to provide separate transition plates or adapter plates which, at their respective contacting edges, are adapted to the thickness of the adjacent plates.

SUMMARY OF THE INVENTION

It is the object of the present invention to develop a door or gate leaf as described above such that, while maintaining a protection against the squeezing-in of fingers of a person, the edge regions of the plates forming the door leaf are formed so that a change in thickness of adjacent plates is possible without changing the edge profile and without providing any transition plates or adapter plates.

Proceeding from a door leaf as described above said object is solved according to the invention by the added features of the convex or concave profile section changing from a central curved section into a straight-line section being directly obliquely towards the front wall, and the nose formed in a concave profile section in the region of the front wall being flattened in an incline manner from outside.

Accordingly, the convex or concave profile section changes from a central curved section into a straight-line section being directed obliquely towards the front wall, which intersects the plane formed by the front wall at an angle $\alpha$. The nose formed in the concave profile section in the region of the front wall is flattened from its outer side in an inclined manner.

Hence, when viewed from the front wall, the newly created door leaf does no longer have a shoulder which is formed at the convex part of the plate profile and lies opposite to the nose. No bead is any longer formed between the nose of the concave plate part and the respective shoulder of the convex part. The beveled surface of the convex part rather tapers off up to the front wall. At the opposed nose in the region of the concave profile part of the plate, the nose formed in the region of the front wall is flattened in an inclined manner from its outer side so that the respective nose comes to lie in a region of the straight-line section of the profile being directed obliquely towards the front wall which is spaced apart from the plane being formed by the front wall.

Due to said geometry, however, also the thickness of the adjacent plates may be varied, as, when there is a transition from a thicker plate with a convex part, the adjacent thinner plate with its nose section also only has to end in the straight-line section being directed obliquely towards the front wall. Thus, principally, the same profiling may be maintained in the plate edge region.

Said geometry may be used for small door leaf plates as well as for comparatively broad door leaf plates which are also designated as panels.

Advantageous embodiments of the invention result from the subclaims following the main claim. According thereto, the angle $\alpha$ is to be chosen advantageously such that it lies between 23.5° and 25°, and preferably amounts to 24.3°.

The sections of the front faces of adjacent plates lying closest to the rear walls, respectively, may each extend in an inclined manner in the direction towards the hinge axis.

The plates of the door leaf may each consist of a frame made of metal or plastics. Preferably, the frame consists of a formed sheet metal which may be filled by foaming with a foamable material in the inside.

In addition, the plates may be equipped with a protective covering panel in their rear wall region in compliance with DE 297 21 316.

BRIEF DESCRIPTION OF THE DRAWINGS

Further details and advantages of the invention result from the embodiment represented by means of the sole FIGURE.

The sole FIGURE shows a schematic partial cross-section through the partial regions at the ends of two adjacent plates of one embodiment.

DESCRIPTION OF THE PREFERRED EMBODIMENTS

In the sole FIGURE there is shown a cutout of a door leaf 10 in which there are represented partial regions of a plate 12 and an adjacent plate 14 hingedly connected thereto via hinge connections not shown in detail here. The plates 12 and 14 are shown in a closed position. Plate 14 has a front wall 16 and a rear wall 18 and a projection 22 at its side edge section 20 which has a nose-like cross-section and has a profile section 24 which is of a curved convex design and is directed towards the front wall 16, a straight-line section 25 being adjacent to the front wall 16 and cutting the same at an angle $\alpha$, and a section 26 directed towards the rear wall 18 and extending in an inclined manner in the direction towards the hinge axis which is not shown in detail here.

The section 25 directed obliquely towards the front wall intersects the plane formed by the front wall 16 at an angle $\alpha$ of 24.3°.

At the plate edge 28 of the adjacent plate 12 there is complementary provided a recess 30 with which the nose-like projection 22 comes into engagement when the plate 12 is pivoted for closing. Said recess has a concave profile section being complementary to the convex profile section 22. Furthermore, a beveled section 34 corresponding to the beveled section 26 is provided. In the concave profile a straight-line section 37 corresponds to the straight-line section 25 directed towards the front wall. Together with the front wall 16 of the plate 12, the inclined profile section 37 forms a nose-like projection 38, as is represented in the drawing. Said nose-like projection 38 has a section 39 at its front side which is flattened in an inclined manner, as is shown in detail in the FIGURE.

The nose-like projection 38 is shortened by the inclined flattening to such an extent that the corresponding nose-like projection or nose 38 comes to lie in a region of the straight-line section 25 of the profile 22 which is directed obliquely towards the front wall 16 and which is spaced apart from the plane formed by the front wall 16. Thus, the nose-like projection or nose 38 does not extend up to the transition from the inclined profile section 25 to the straight front wall 16, as becomes also apparent from the FIGURE.

As a result of the chosen geometry, the thickness of the adjacent plates may be varied, as, when there is a transition from a thicker plate with a convex part, the adjacent thinner plate with its nose section also only has to end in the straight-line section directed obliquely towards the front wall. This is illustrated by means of the form of plate 12 drawn in broken lines. While the plate 12 drawn in a continuous line has a thickness d1 which corresponds to the plate thickness d1 of the plate 14, the plate 12 drawn in broken lines has a thickness d2 which is smaller than the thickness d1. The thinner plate which is represented in the FIGURE with a broken line, also ends with its nose-like projection in the inclined section 25 of the convex projection 22.

When pivoting the plates 12 and 14 with respect to each other, between the convex profile section 24 of the nose 22 as well as the concave profile section of the recess 30 there is only left a very narrow gap of few millimeters which reliably prevents a squeezing-in of the fingers of a person. In said gap there may be additionally provided a sealing 40.

In the embodiment shown here, the plates 12 and 14 are designed as metal sheet parts. The metal sheet parts may be filled by foaming with a foamable plastics material in a manner not explained here.

However, within the frame of the present invention the material of the plates may be chosen freely.

What is claimed is:

1. Doorleaf (10) with a plurality of plates (12, 14) hingedly connected to each other via hinge connections, said plates (12, 14) being pivotable with respect to each other when they are moved from open position to closed position or vice versa, wherein the plates (12, 14) each have a front wall (18) and a rear wall (16) as well as at least one plate edge (28, 20) resting against a respective plate edge (20, 28) of an adjacent plate (14, 12), a first plate edge (28) has a profile with a profile section (30) having a substantially concave design, a second plate edge (20) lying opposite thereto has a convex-shaped profile section (24) being complementary to the concave-shaped profile section (30), the convex profile section (24) comprises a central curved apex pointed in a longitudinal direction of adjacent plates (12, 14) in the closed position and the concave profile section (30) comprises a complementary central curved base structured and arranged to receive said apex in the closed position in a complementary manner, said convex profile section (24) comprises a straight-line section (25) extending, without interruption, from said curved apex to said front wall (16) and said concave profile section (30) comprises an uninterrupted complementary straight line section (37) extending without interruption from said curved base to said front wall (16) and structured and arranged to receive said convex straight line section (25) in the closed position, a nose (38) is formed in the concave profile section (30) between the front wall (16) and straight line section (37), with an outer side of said nose (38) between the front wall (16) and an apex of said nose (38) being straight or flattened in an inclined manner, such that in the closed position, said nose (38) apex points downwardly to said convex straight line section (25) and entirely lies within a region of said convex straight line section (25) directed obliquely to the front wall (16) thereof, and with said region of said convex straight line section (25) being spaced away from a plane formed by the front wall (16) thereof, and adjacent plates (12, 14) have different thicknesses ($d_1$, $d_1$,) from each other over the entire height of each said plate (12, 14).

2. Door leaf according to claim 1, characterized in that portions of the edges of the adjacent plates lying closest to the rear walls extend in an inclined manner in the direction towards a hinge axis.

3. Door leaf according to claim 2, characterized in that the straight-line section of the convex or concave profile section which is directed obliquely towards the front wall intersects the plane formed by the front wall at an angle $\alpha$ of 23.5° through 25°.

4. Door leaf according to claim 3, wherein the angle is 24.3°.

5. Door leaf according to claim 1, characterized in that the straight-line section of the convex or concave profile section which is directed obliquely towards the front wall intersects the plane formed by the front wall at an angle α of 23.5° through 25°.

6. Door leaf according to claim 5, wherein the angle is 24.3°.

7. Door leaf according to claim 5, wherein the straight-line section of the convex profile section intersects the plane formed by the front wall thereof at the angle α of 23.5° through 25°.

8. Door leaf according to of claim 1, characterized in that the plates of the door leaf are formed of a frame made of metal or plastics.

9. Door leaf according to claim 8, characterized in that the frame is formed of a shaped sheet metal.

10. Door leaf according to claim 1, characterized in that the thickness of the plates decreases continuously or gradually over the height of the door leaf.

11. Door leaf according to claim 1, wherein a tip of the nose formed in the concave profile section is situated above a plane extending through a hinge axis at right angles to the front and rear walls.

12. Door leaf according to claim 11, wherein the straight-line section of the convex profile section, which is directed obliquely toward the front wall intersects the plane formed by the front wall at an angle α of 23.5° through 25°.

13. Door leaf according to claim 1, wherein the nose does not extend up to a transition from the inclined straight-line section of the convex profile section to the straight front wall.

14. Door leaf according to claim 1, additionally comprising rear beveled sections arranged on the convex and concave profile sections to extend from the central curved section thereof, obliquely towards the rear wall.

15. Door leaf according to claim 1, wherein said plates are arranged such that during pivoting with respect to one another, only a very narrow gap of a few millimeters remains between the respective convex and concave profile sections to reliably prevent accidental squeezing therein of fingers of an individual.

16. Door leaf according to claim 1, wherein the plate comprising said concave profile section is thinner than said plate comprising said convex profile section.

* * * * *